United States Patent [19]

Migliori

[11] Patent Number: 4,991,494

[45] Date of Patent: Feb. 12, 1991

[54] SEALING DEVICE FOR RODLESS PNEUMATIC CYLINDERS

[75] Inventor: Luciano Migliori, Milan, Italy

[73] Assignee: Univer S.p.A., Milan, Italy

[21] Appl. No.: 360,980

[22] Filed: Jun. 2, 1989

[30] Foreign Application Priority Data

Jun. 8, 1988 [IT] Italy ..... 20900 A/88

[51] Int. Cl.[5] ..... F01B 29/00

[52] U.S. Cl. ..... 92/88; 277/DIG. 7

[58] Field of Search ..... 92/88; 277/DIG. 7

[56] References Cited

U.S. PATENT DOCUMENTS

| | | | |
|---|---|---|---|
| 2,745,382 | 5/1956 | Heintzen . | |
| 3,019,813 | 2/1962 | Dommann | 92/88 |
| 4,373,427 | 2/1983 | Garlapaty et al. | 92/88 |
| 4,545,290 | 10/1985 | Lieberman | 92/88 |
| 4,555,980 | 12/1985 | Hoglund | 92/88 |
| 4,685,383 | 8/1987 | Ruchser | 92/88 |
| 4,714,007 | 12/1987 | Maisch | 277/DIG. 7 |
| 4,733,604 | 3/1988 | Lipinski | 92/88 |
| 4,829,881 | 5/1989 | Taki et al. | 92/88 |
| 4,856,415 | 8/1989 | Noda | 92/88 |

FOREIGN PATENT DOCUMENTS

| | | | |
|---|---|---|---|
| 0104364 | 4/1984 | European Pat. Off. | 92/88 |
| 0147803 | 7/1985 | European Pat. Off. . | |
| 846493 | 3/1953 | Fed. Rep. of Germany . | |
| 2306760 | 8/1973 | Fed. Rep. of Germany | 92/88 |
| 2163499 | 2/1986 | United Kingdom . | |

*Primary Examiner*—Edward K. Look
*Assistant Examiner*—Thomas Denion
*Attorney, Agent, or Firm*—Fleit, Jacobson, Cohn, Price, Holman & Stern

[57] ABSTRACT

A sealing device for a rodless pneumatic cylinder comprising a hollow body having an elongated chamber in which a reciprocating piston slides. The cylinder has a longitudinal slot and sealing means in the form of a flexible strip passing through a longitudinal passageway in the piston; the sealing strip has a width greater than that of the slot and longitudinally extending retaining bead members engaging and disengaging grooves inside the cylinder body, spaced apart from the central slot. The sealing strip also comprises sealing lips fitting against bevelled edges on a side of the retaining grooves. The strip is provided with a reinforcement to withstand the mechanical stresses caused by the reciprocating piston.

12 Claims, 3 Drawing Sheets

SEALING DEVICE FOR RODLESS PNEUMATIC CYLINDERS

BACKGROUND OF THE INVENTION

This invention refers to fluid actuated rodless cylinders and more particularly relates to a sealing device for pneumatic cylinders without rod of the type having a hollow body or barrel defining an elongated chamber in which a piston member reciprocates, said piston being connected to a power transmission element through a slot longitudinally extending on a wall of the cylinder.

Cylinders without rod have long been used to effect reciprocating movements or positioning of objects by using pressurized fluid, generally, compressed air, as power source. These rodless cylinders, See GB-A-2163499, EP-A-0147803, U.S. Pat. No. 2,745,382 and DE-C-846493, differently from traditional cylinders provided with a power transfer rod protruding from one or both ends, transfer rod protruding from one or both ends, usually have a longitudinally sliding carriage or power transmission element movable on the cylinder body; the power transmission element is directly connected to a piston member inside the barrel of the cylinder through a longitudinal slot of adequate width. A sealing element consisting of a flexible strip is located inside the cylinder chamber and is urged by the pressurized fluid against the inner surface of the chamber to cover the slot to form a seal. An analogous sealing strip may be provided on the outside of the cylinder body along the longitudinal slot to prevent the entrance of dust. The internal and external sealing strips go through longitudinal passage ways in the piston and carriage members, which are provided with adequate spreading means to spread apart and respectively to approach the strips to the body of the cylinder during the reciprocating movement of the piston.

According to GB-A-2163499 and EP-A-0147803 the sealing strip comprises a sealing portion for creating a seal against an inner side wall of the cylinder barrel, adjacent the longitudinal slot, and retaining portions adapted for engagement with the inner and of the outer surfaces of the barrel along said longitudinal slot. The use of retaining portions protruding inside the longitudinal slot of the cylinder do not permit the power transmission element connected to the reciprocating piston member, to be adequately guided during reciprocations movement along the cylinder resulting in difficulties to withstand to lateral reaction forces acting on said power transmission element. Furthermore, the use of retaining members protruding into the longitudinal slot does not prevent the pressurised fluid from excaping at the failure of the sealing portions of the strip. From DE-D-846493 it is also known a sealing device comprising a V-shaped sealing strip provided with longitudinal retaining members protruding into lateral grooves of the cylinder, having lateral surfaces parallelly arranged to radial surfaces of the longitudinal slot; according to this device the sealing action is therefore provided pressing the outer surface of the strip, between the retaining members, against the inner surface of the cylinder, near to said longitudinal slot. Owing to the thickness of the middle portion of the sealing strip, and consequently its reduced flexibility in a cross-wise direction, the sealing action may be reduced or compromised by wearing or any injuring of the sealing strip. Furthermore, in cylinders having long barrels, the long sealing strip may not be prevented from falling down, in absence of pressurised fluid into the chamber, when the longitudinal slot and the sealing strip are oriented upwardly or on a side.

An object of present invention is to provide a sealing device for rodless fluid actuated cylinders designed to avoid the disvantages of the sealing devices in rodless cylinders previously known.

In particular, a main object of the invention is to provide a sealing device for rodless cylinders allowing the sealing strip to be positively engaged with longitudinal grooves inside the barrel, in absence of pressurised fluid while maintaining the longitudinal slot completely free from the strip retaining means and providing guiding surface for the power transmission member on both sides of the slot.

A further object of the invention is to provide a rodless cylinder having a sealing device designed to improve and to maintain the sealing action by the retaining members, at the failure of the sealing strip, preventing the pressurised fluid to escape.

SUMMARY OF THE INVENTION

These and other objects of the invention can be reached trough a sealing device for a pneumatic rodless cylinder comprising a barrel provided with a longitudinal slot, having radially extending side walls, a piston member reciprocable within said barrel, and a power transmission means operatively connected to said piston member through said slot, the sealing device comprising at least a first sealing strip longitudinally extending on said slot, said sealing strip freely passing through a longitudinal passageway in the piston member, and retaining means for the sealing strip, said retaining means comprising longitudinal bead member on both sides of the sealing strip, said bead members being engageable and disengageable with retaining grooves inside the barrel on both sides of said slot, said strip having tapered lips outwardly protruding from said longitudinal beads, and bevelled edges on the outer side of the retaining grooves, said beads members and said retaining grooves comprising sealingly abuting inner surfaces inwardly protruding from said beads members.

BRIEF DESCRIPTION OF THE DRAWINGS

The invention will now be desccribed in greater detail, with reference to the figures of the accompanying drawings, in which.

DESCRIPTION OF THE INVENTION

Figure 1:
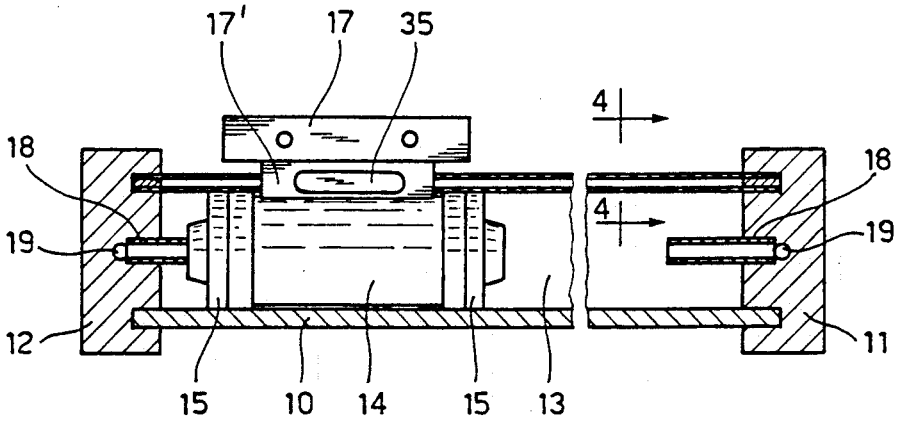
FIG. 1 shows a longitudinal cross-sectional view of a rodless cylinder comprising the sealing device according to this invention.

The following is a description of the general characteristics of a pneumatic cylinder without rod; with reference to FIG. 1 the pneumatic cylinder comprises a hollow body in the form of a barrel 10 sealingly closed at its ends by two heads or end cups 11 and 12 in such a way as to define a cylindrical chamber 13 in which slides a piston member 14 provided at its ends with cushioning and sealing gaskets 15.

The cylinder body 10 is provided with a longitudinal slot 16 (FIG. 4) on one side of its walls, through which passes a stem 17' attached to the piston 14 and to an external carriage 17 defining a power transmission element. The carriage 17 with stem 17' extending through slot 16 toward the piston 14 to which it is mechanically connected, can be manufactured and designed in any way and shape, for example it can be die-cast as a single piece to improved mechanical rigidity.

Cylinder heads 11 and 12 can be differently manufactured and attached to body 10 by, for example, bolts or similar meand; the heads can also comprise check valves or blocking valves; also, each head, in a way which is already known, can have a shock-absorption and deceleration device. Such a device includes, for example, a tube 18 having an appropriate sealing gasket at its free end, not shown, which communicates with a vent hole 19 and comprises a fine-threaded screw (not shown) which allows for exact adjustment for the deceleration of piston 14. Piston 14 has corresponding conical holes 20 at its ends; these holes 20 are penetrated by tubes 18 at the end of piston stroke.

Sealing means for internal and external sealing of the cylinder chamber 13 have been provided along the longitudinal slot 16 of the cylinder to prevent the pressurised fluid from escaping during reciprocating movement of the piston member 14. Such sealing means are in the form of flexible strips 21 and 22, shown in enlarged detailed view in FIG. 4, freely passing through longitudinal passageways in the piston and carriage bodies.

Both internal and external strips 21, 22 have a greater width than the central slot 16 and comprise a flat wall portion 21*a*, 22*a* in wear-resistant thermoplastic material which is resistant to mechanical stresses, for example in polyurethane or polyester materials; wall portions 21*a* and 22*a* of the sealing strips 21, 22 on the sides respectively facing the internal and external surface of cylinder 10, in proximity to the lateral edges or lips 29 comprise retaining means in the form of longitudinal legs or bead members 23 and 24 engaging and disengaging respective retaining grooves 25 and 26 into cylinder body 10, parallel to and laterally spaced from central slot 16. To avoid overlapping of grooves 25 of internal sealing strip 21 with grooves 26 of external sealing strip 22, the latter has a greater width than internal sealing strip 21, as shown.

Both retaining legs 23, 24 and retaining grooves 25, 26 have protruding parts or opposed facing surfaces which are adequately slanted or rounded to improve sealing action and facilitate withdrawal and introduction of the legs of each sealing strip into said retaining grooves by reciprocating movement of piston 14.

Each sealing strip 21, 22 is formed in a single piece together with its respective retaining legs 23 and 24 by moulding or extrusion of plastic material. At the same time, to improve the resistance to bending and tensile stress and general to mechanical stretching to which the sealing strips 21 and 22 are subjected during reciprocating movement of piston 14 and power transmission carriage 17, both strips 21 and 22 have been provided with a metallic band 27 and 28 respectively, on the side facing the cylinder body 10. Bands 27, 28 can be applied to each plastic strip after extrusion or, as an alternative, reinforcing wires 27' can be applied or incorporated during moulding or extrusion.

Figure 4:
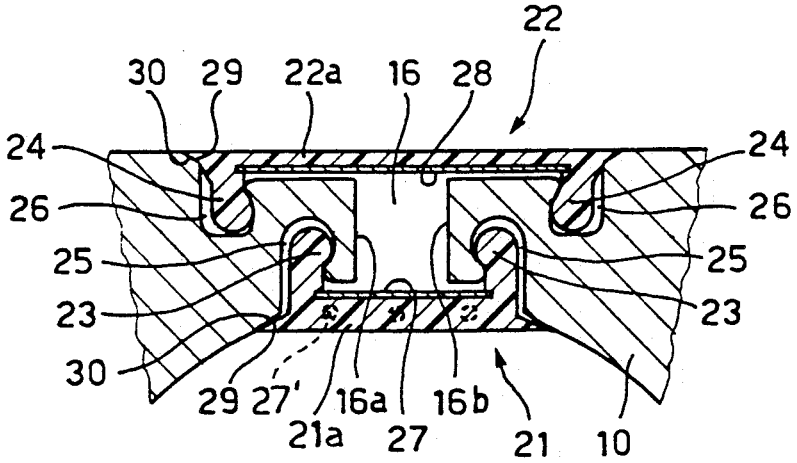
FIG. 4 shows a further detailed cross-sectional view of the seal, along line 4—4 of FIG. 1.

As is shown in the enlarged view of FIG. 4, the fluid seal by internal strip 21, and, similarly, the dust seal by external seal 22, are assured by bevelled lips 29 on the two longitudinal edges of each strip, which fit perfectly against corresponding bevelled edges 30 on the outer sides of each of the retaining grooves 25 and 26 which are at a greater distance from central slot 16.

As shown in FIG. 4 the retaining legs 23, 24 of the two sealing strips and the bevelled sealing lips 29 are located at a distance from central slot 16; thus, the slot 16 remains completely free for the sliding of carriage 17. Furthermore, the use of sealing strips in thermoplastic material, combined with a metallic reinforcing band on the side facing slot 16, allows further improvement of working conditions in that sealing action is assured by bevelled lips 29 of the plastic strip, while the metallic reinforcing band prevents unloading of mechanical bending and stretching stresses, which are caused by the sliding of carriage 17, onto the plastic strips, thus avoiding repeated and dangerous stretching or lengthing.

Figure 2:
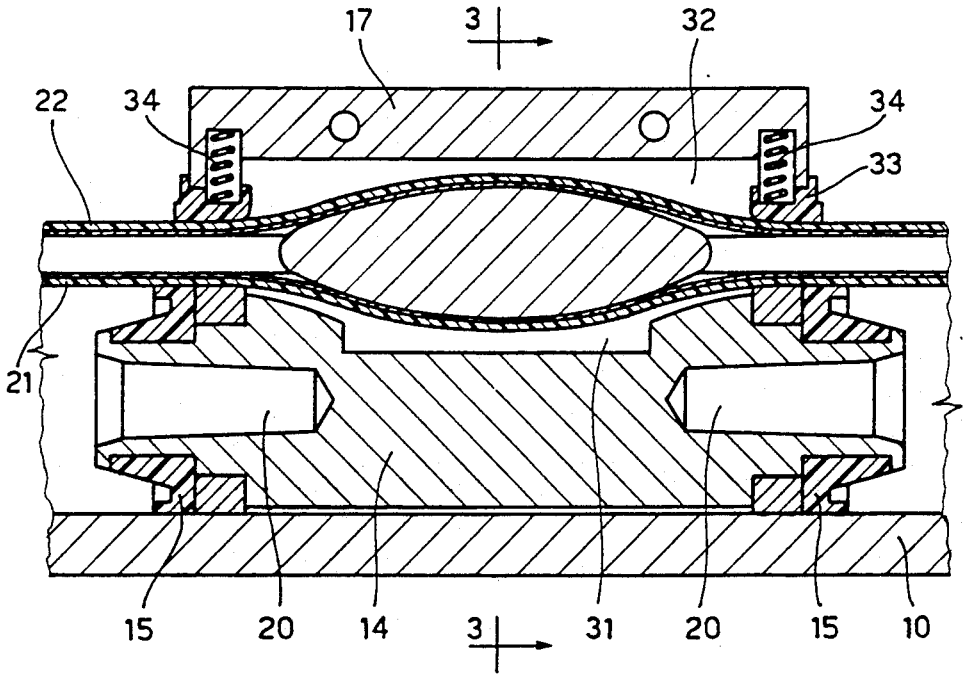
FIG. 2 shows a detailed enlarged view of the cylinder of FIG. 1.

As is shown in FIGS. 1 and 2, the two sealing strips 21 and 22 are usually engaged with their legs 23 and 24 in the retaining grooves 25 and 26, except for the portions passing through piston 14 and power transmission carriage 17 where the two sealing strips are spaced apart to allow reciprocating movement of piston 14. At the same time, piston 14 and carriage 17 have two longitudinal passageways 31 and 32 which converge in the direction of the ends of piston 14 in such a way as to increase and respectively decrease the spacing between sealing strips 21 and 22 during reciprocating movement of piston 14.

Figure 3:
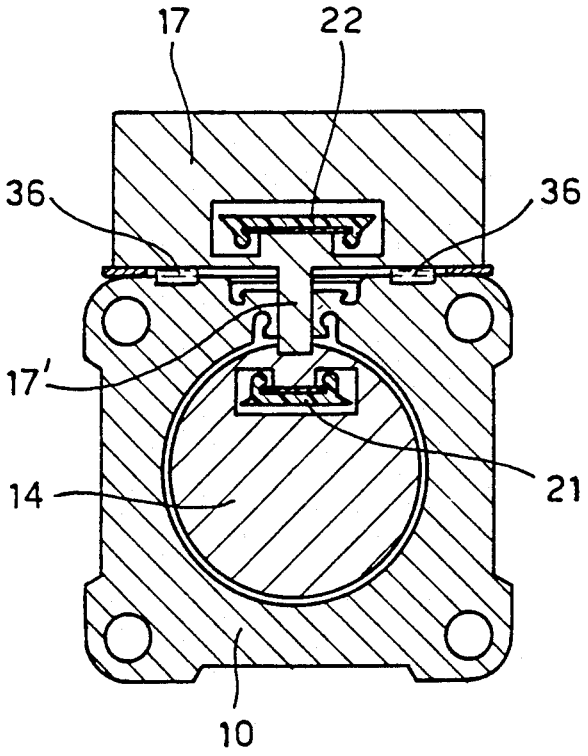
FIG. 3 shows a cross-sectional view along line 3—3 of FIG. 2.

A dust-sealing gasket 33 co-operate with the carriage 17 and is arranged around the outer sides of carriage 17 to press against the external gasket 22 which is co-planar to the cylinder wall; the ends of dust-sealing gasket 33 are urged by springs 34 against the external surface of cylinder 10 and external sealing strip 22 in such a way as to constantly maintain their cleanliness. Sealing gasket 33 can in any case be shaped and arranged on carriage 17 in combination with a set of rollers. balls or similar rolling members 36 (FIG. 3) which can be arranged, if desired, in appropriate rolling tracks between opposite surface of carriage 17 and the cylinder barrel or hollow body 10 of the cylinder.

As previously mentioned, the sealing strips 21 and 22 act upon cylinder body 10 in positions which are spaced apart from central slot 16. Therefore, the latter is completely free for passage of the shank or stem 17' connecting the power transmission carriage 17 to the piston 14. This solution allows lateral walls 16*a* and 16*b* of slot 16 to be used as resting and guiding surfaces for carriage 17 and for withstanding lateral loads acting on the same carriage. In this way carriage 17 is accurately guided during reciprocating movement of piston 14, thus avoiding damage to the cylinder. Guiding of carriage 17 can be improved by providing for insertion of anti-frictional bars 35 into shank 17' of the carriage, as schematically shown in FIG. 1.

Figure 5:
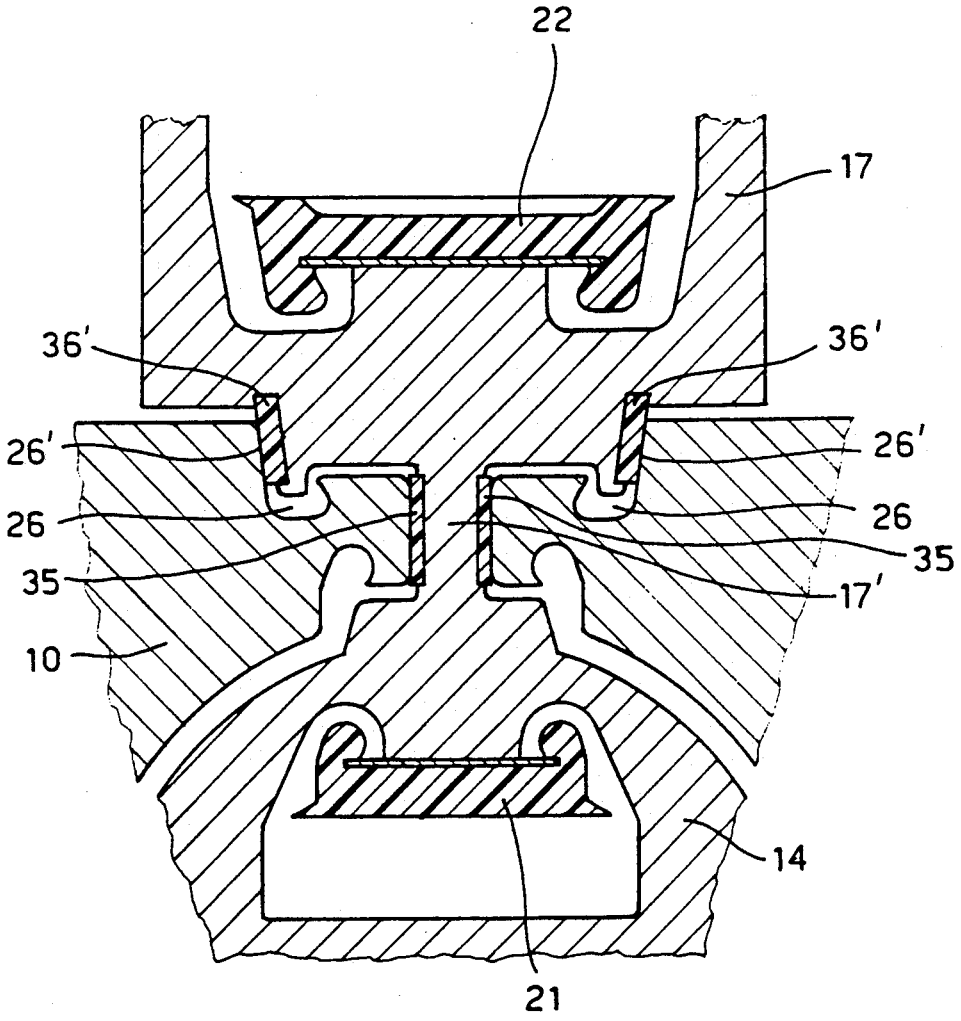
FIG. 5 shows in detail a portion of FIG. 3.

As shown in FIG. 5, in addition to anti-frictional members 35 sliding against side surfaces 16*a*, 16*b* of the central slot 16, further anti-frictional members 36' may be provided on lateral surfaces of the carriage 17 to slide against flat guiding surfaces 26' of grooves 26; this improves the sliding and the ability of the carriage 17 to oppose the lateral thrusts.

It will be clear, from the foregoing description and accompanying drawings, that the sealing system according to this invention has a number of advantages over existing known systems. In particular the use of slanted and rounded retaining legs and grooves provides a supplemental sealing action in respect to bevelled edges 29 as well as a snap fitting action of the legs into and out of the retaining grooves.

Furthermore, the use of a metallic reinforcing band which is designed to come into contact with the piston body or power transmission carriage allows manufacturing of the sealing strips by simple extrusion of anti-wear thermoplastic material, for example polyurethane or polyester, obtaining formation, during extusion, of two tapered lateral lips which guarantee the seal on each side of the strip. Also, the presence of retaining elements in the form of flexible longitudinal legs which fit into grooves parallel to the central slot not only allow the latter to remain completely free for correct guiding of the carriage, but also further improve the seal in that an eventual surge in fluid pressure, which could be caused on the inside of grooves 25 by an seal defect of lips 29, would tend to push legs 23 of internal gasket 21 against the opposing wall of grooves 25, preventing in every case the escape of pressurized fluid to the outside; this is of great importance in all uses in which the cylinder undergoes vibration or repeated lateral loads which could cause momentary detachment of the lateral lips of each strip from their respective sealing surfaces. In this way, one obtains a system of improved sealing at a comparatively reduced cost.

What is claimed is:

1. A rodless cylinder comprising a barrel and end caps defining a cylindrical chamber, said barrel being provided with a longitudinal slot; a reciprocable piston member within said chamber operatively connected to a power transmission means through said slot; a sealing device comprising a flexible sealing member longitudinally disposed and extending inside of the chamber along said slot, said sealing strip freely passing through a deflecting passageway in the reciprocable piston member; engageable and disengageable retaining means for the sealing strip, said retaining means comprising parallel retaining grooves formed in an interior wall of the barrel on opposite sides of the slot respectively, and longitudinal headed bead members on opposite sides of the sealing strip; said grooves having respective recessed inner wall surfaces facing away from the slot and said bead members having respective inner sealing surfaces facing towards the slot for sealingly engaging and disengaging against the respective inner wall surfaces of the grooves; said sealing strip further comprising tapered outwardly protruding lips for contacting bevelled sealing surfaces provided on the interior wall of the barrel outwardly of the respective retaining grooves.

2. A device as claimed in claim 1 wherein said inner wall surfaces have a concave curvature and said inner sealing surfaces have a corresponding convex curvature.

3. A device as claimed in claim 1, in which a second sealing strip is provided on the external side of the slot, said second sealing strip having longitudinal retaining beads engageable and disengageable with outer longitudinal grooves of the barrel, said outer sealing strip being larger than, and said outer grooves being spaced apart at a greater distance with respect to the internal sealing strip.

4. A device as claimed in claim 1 in which the sealing strip includes reinforcing means.

5. A device as claimed in claim 4, in which said reinforcing means includes a metallic band longitudinally extending on a side of the strip facing the central slot of the cylinder.

6. A device as claimed in claim 5 in which the metallic reinforcing band is arranged between the longitudinal retaining beads of the sealing strip.

7. A device as claimed in claim 4 in which said reinforcing means includes reinforcing wires embedded in said sealing strip.

8. A sealing device according to claim 1 in which the power transmission means comprises a carriage sliding on the external surface of the cylinder body and in which an anti-dust gasket is arranged around said carriage, the device further comprising biasing means on the carriage urging the anti-dust gasket against the external surface of the cylinder body and respectively against the external sealing strip.

9. A device as in claim 8, in which a guiding means is provided for said power transmission carriage.

10. A device as in claim 9, in which said guiding means includes anti-frictional members between a connecting stem portion of the carriage and the lateral walls of the longitudinal slot.

11. A device as in claim 9, in which said guiding means includes sliding tracks for rolling elements between opposing surfaces of said cylinder body and power transmission carriage.

12. A device according to claim 9 in which said guiding means comprises anti-frictional members between side surfaces of the carriage and side surfaces of retaining grooves of said outer sealing strip.

* * * * *